US010544982B2

(12) United States Patent
Kim et al.

(10) Patent No.: US 10,544,982 B2
(45) Date of Patent: Jan. 28, 2020

(54) REFRIGERATOR

(71) Applicant: LG Electronics Inc., Seoul (KR)

(72) Inventors: Hyunbum Kim, Seoul (KR); Jindong Kim, Seoul (KR); Jihyun Im, Seoul (KR); Sanggyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/545,407

(22) PCT Filed: Feb. 18, 2016

(86) PCT No.: PCT/KR2016/001639
§ 371 (c)(1),
(2) Date: Jul. 21, 2017

(87) PCT Pub. No.: WO2016/137161
PCT Pub. Date: Sep. 1, 2016

(65) Prior Publication Data

US 2018/0010845 A1 Jan. 11, 2018

(30) Foreign Application Priority Data

Feb. 23, 2015 (KR) ..... 10-2015-0025404

(51) Int. Cl.
*F25D 23/02* (2006.01)
*F25D 25/02* (2006.01)
*E06B 7/20* (2006.01)

(52) U.S. Cl.
CPC ..... *F25D 23/02* (2013.01)

(58) Field of Classification Search
CPC ..... F25D 23/04; F25D 23/94; F25D 23/028; F25D 23/065; F25D 23/02;
(Continued)

(56) References Cited

U.S. PATENT DOCUMENTS 9,188,382 B2 * 11/2015 Kim ..... A47B 71/00
9,845,628 B2 * 12/2017 Jung ..... E05F 1/10
(Continued)

FOREIGN PATENT DOCUMENTS

JP H08170871 7/1996

OTHER PUBLICATIONS

International Search Report and Written Opinion in International Application No. PCT/KR2016/001639, dated Jun. 8, 2016, 9 pages (with English translation).

*Primary Examiner* — Melvin Jones
(74) *Attorney, Agent, or Firm* — Fish & Richardson P.C.

(57) ABSTRACT

Disclosed is a refrigerator. The refrigerator includes a cabinet having a storage compartment, an inner case (10) configured to define an external appearance of the storage compartment, a first door pivotably installed to the cabinet, the first door being configured to open or close one side of the storage compartment, a second door pivotably installed to the cabinet, the second door being configured to open or close a remaining side of the storage compartment, the second door having a pillar (100) configured to be rotated so as to come into contact with the first door, and a transfer member (1000) provided inside the inner case (10) so as to guide rotation of the pillar (100) by detecting rotation of the second door, and the pillar (100) is spaced apart from both a top wall of the inner case and a bottom wall of the inner case (10) so as not to come into contact with the inner case (10) in a state in which the second door seals the storage compartment.

18 Claims, 7 Drawing Sheets

(58) Field of Classification Search
CPC .... F25D 2323/021; F25D 25/02; F25D 11/02; F16H 19/04; E06B 7/20; E05C 5/00
See application file for complete search history.

(56) References Cited

U.S. PATENT DOCUMENTS

| | | | | |
|---|---|---|---|---|
| 9,874,391 | B2 * | 1/2018 | Jung | E05C 5/00 |
| 2011/0048060 | A1 * | 3/2011 | Kim | E05B 17/0029 62/449 |
| 2014/0375198 | A1 * | 12/2014 | Jeon | F25D 23/028 312/404 |
| 2015/0260443 | A1 * | 9/2015 | Lee | F25D 23/02 312/404 |
| 2016/0313050 | A1 * | 10/2016 | Yoon | E06B 7/18 |
| 2017/0191738 | A1 * | 7/2017 | Jung | E05C 5/00 |

* cited by examiner

[Fig. 1]
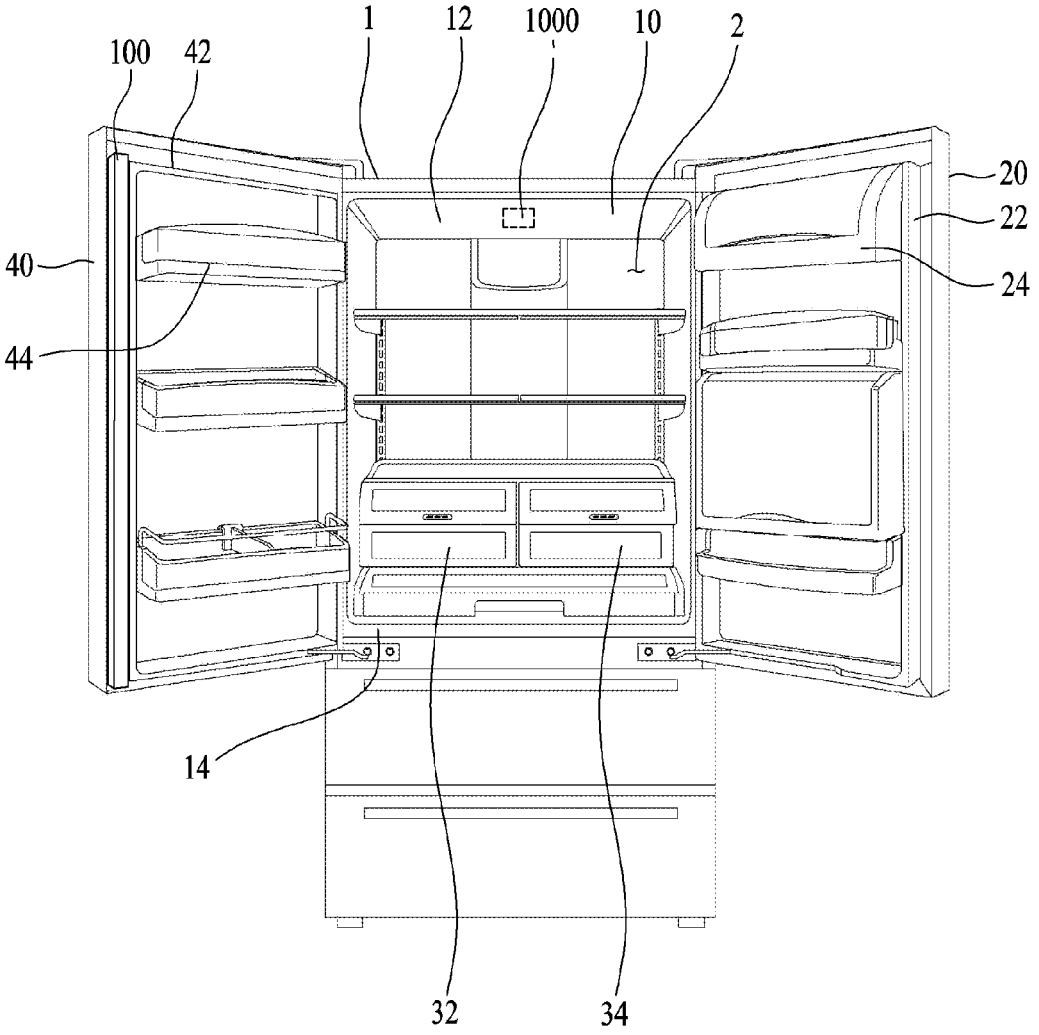

[Fig. 2]
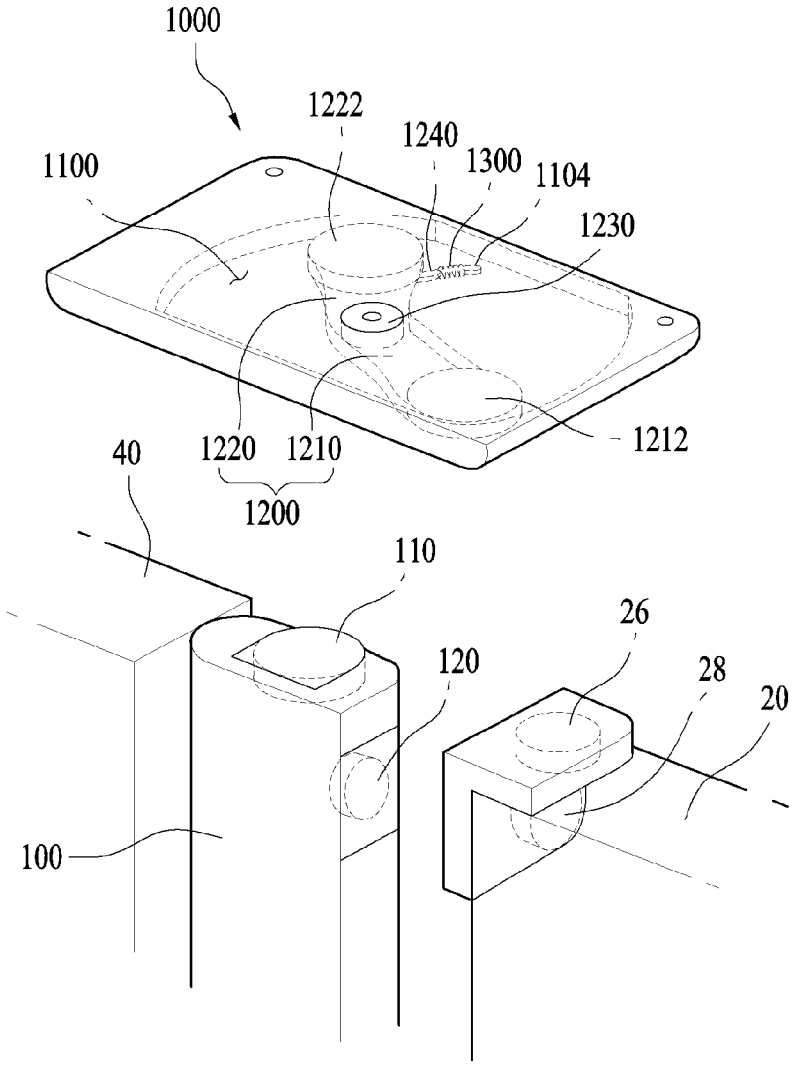

[Fig. 3]
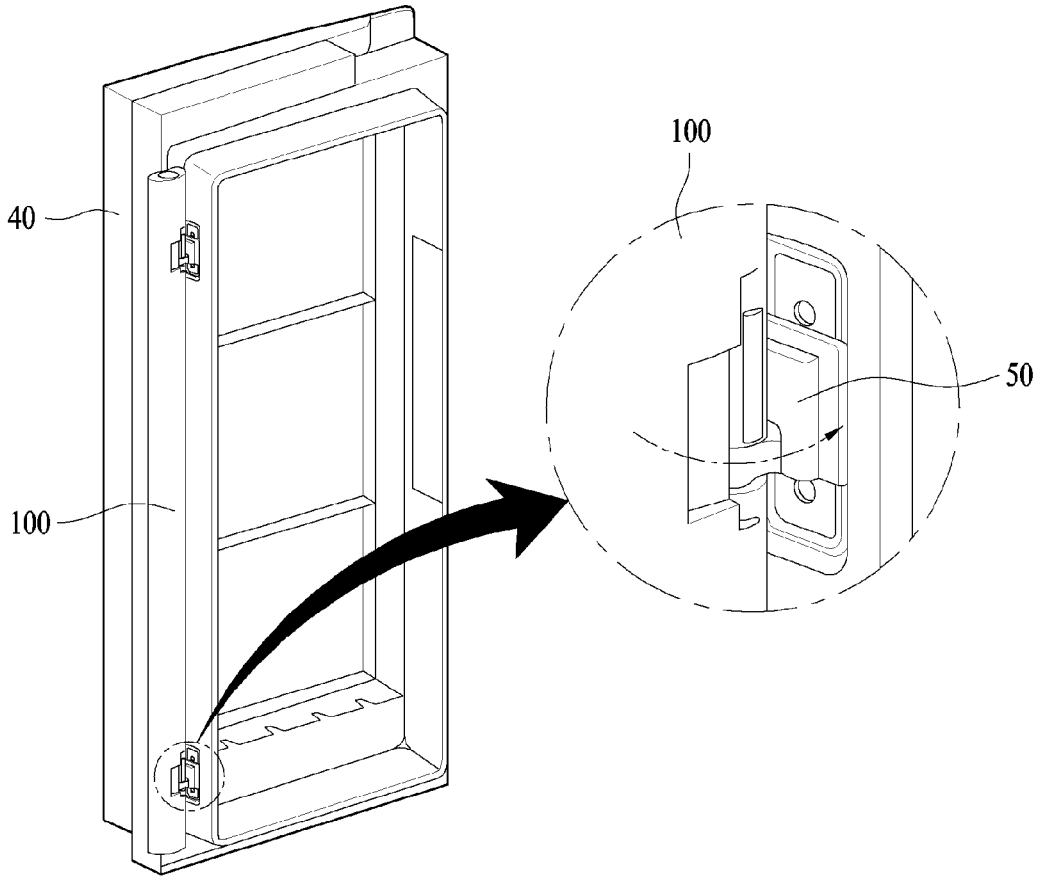

[Fig. 4]
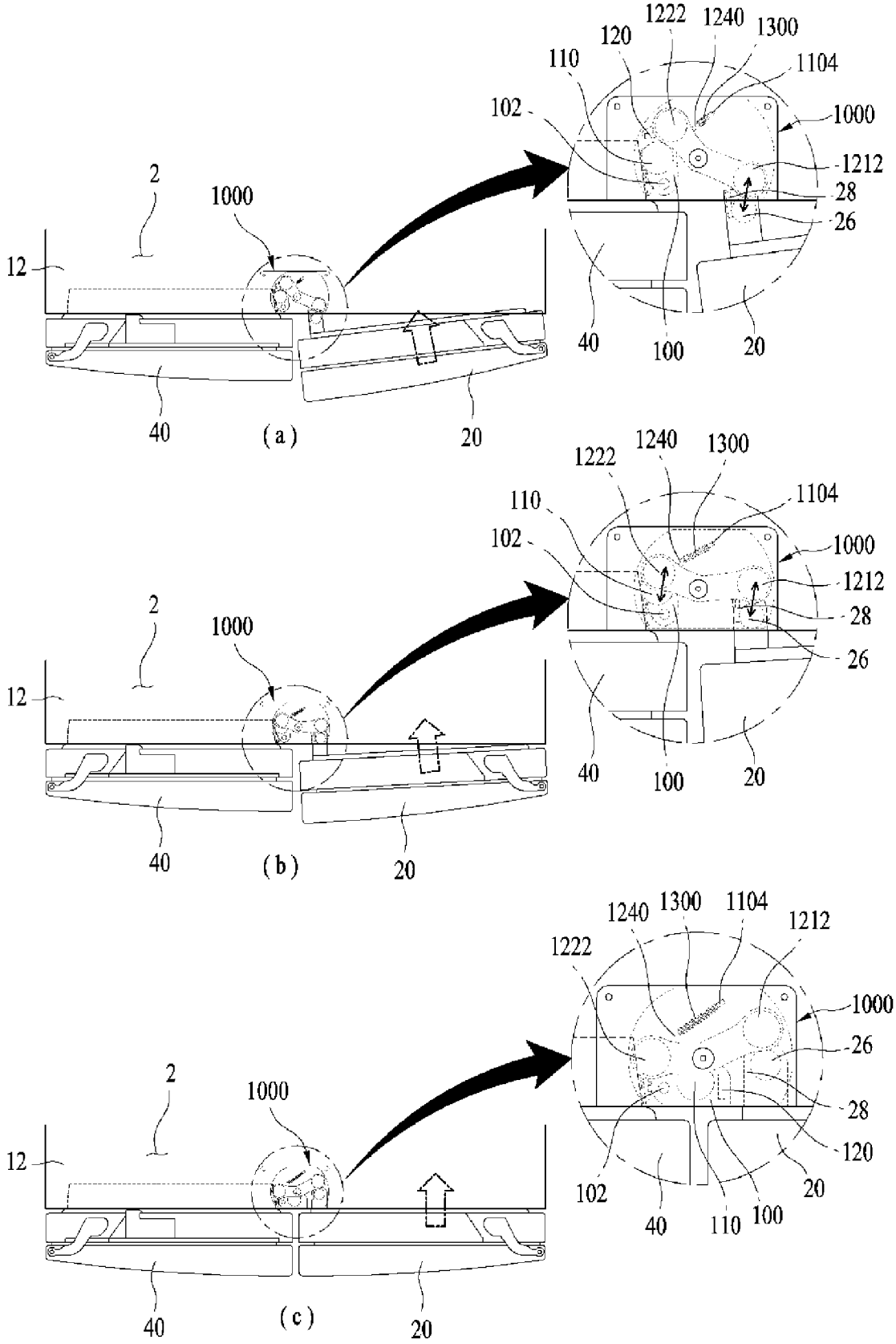

[Fig. 5]
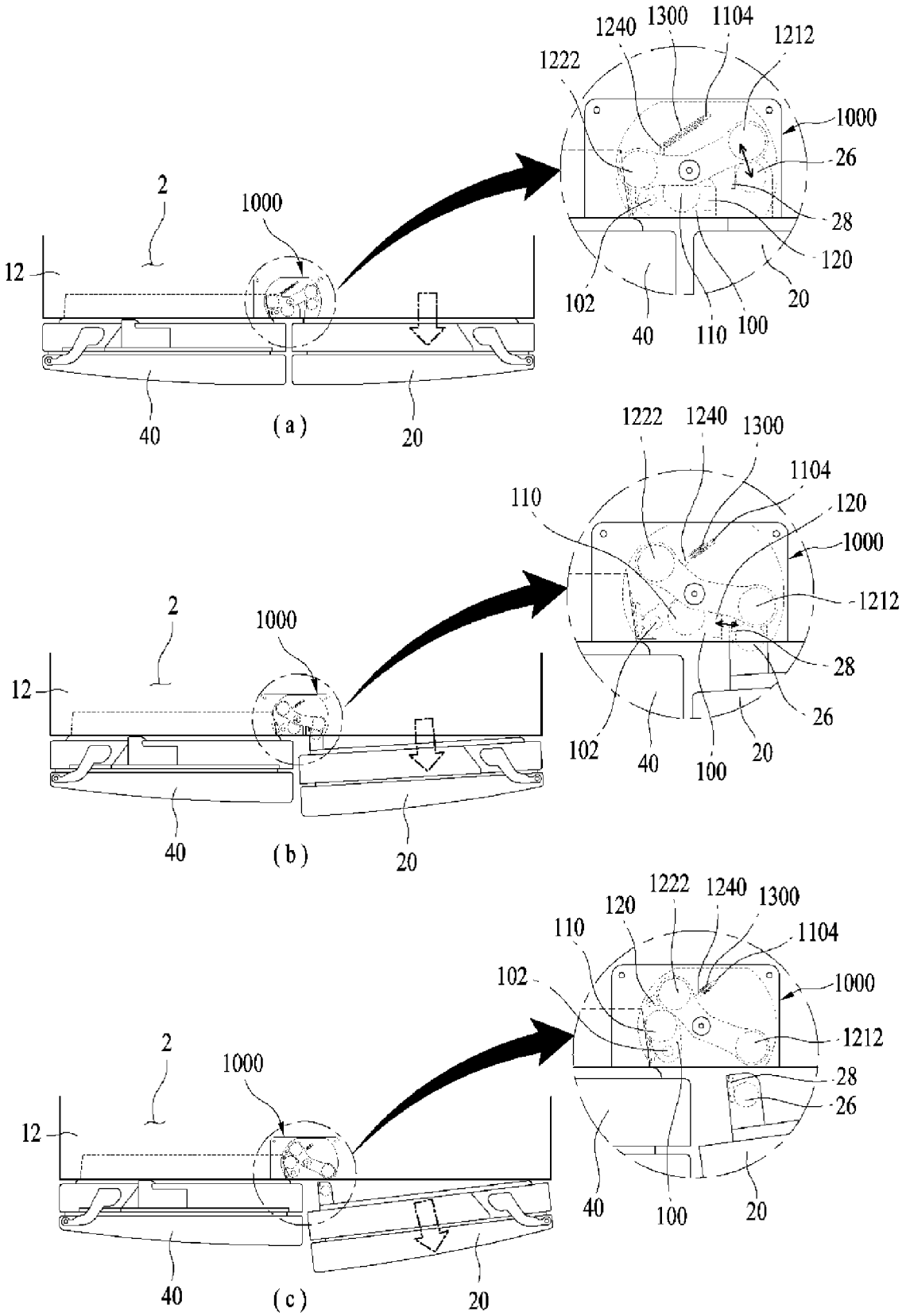

[Fig. 6]
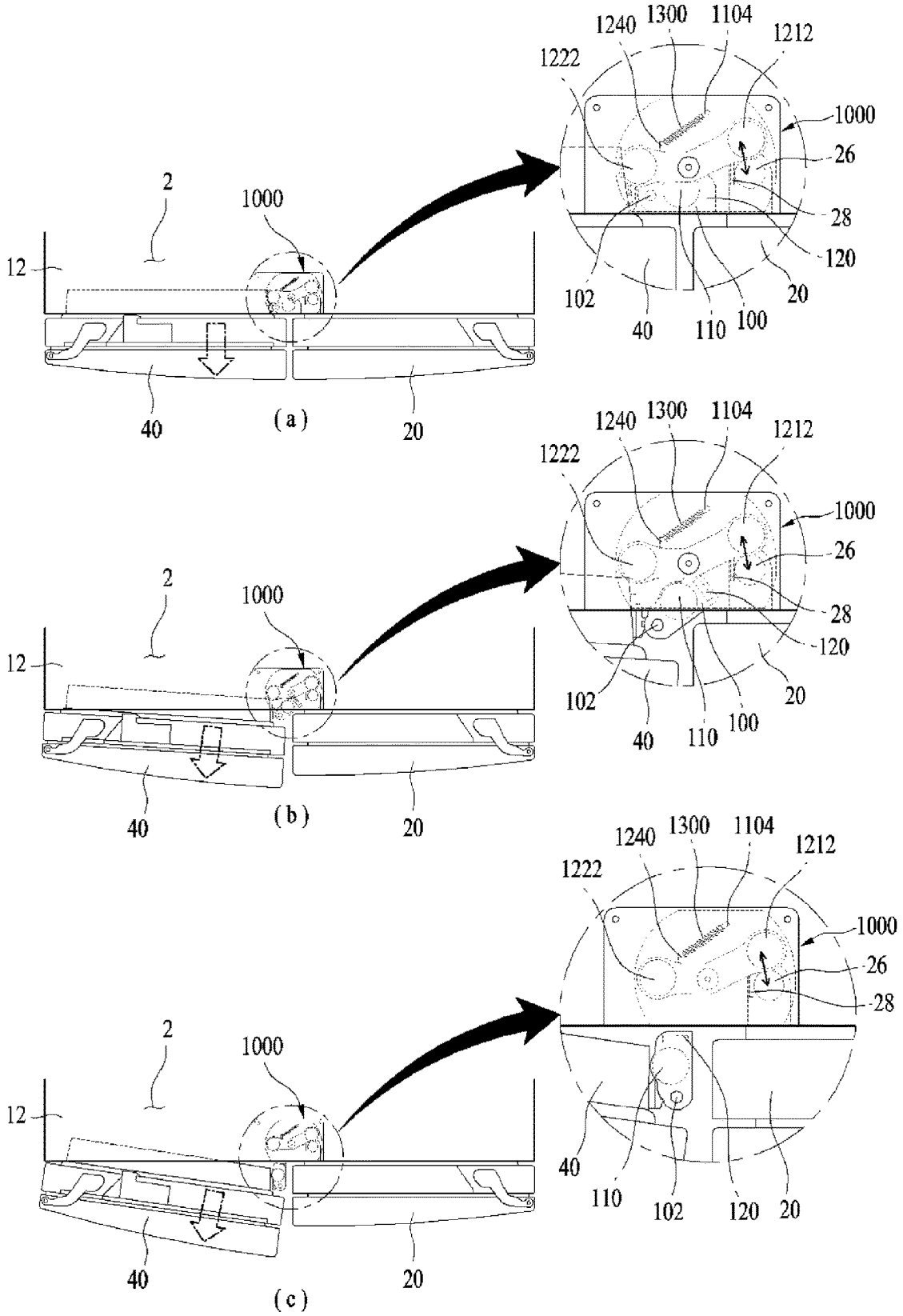

[Fig. 7]
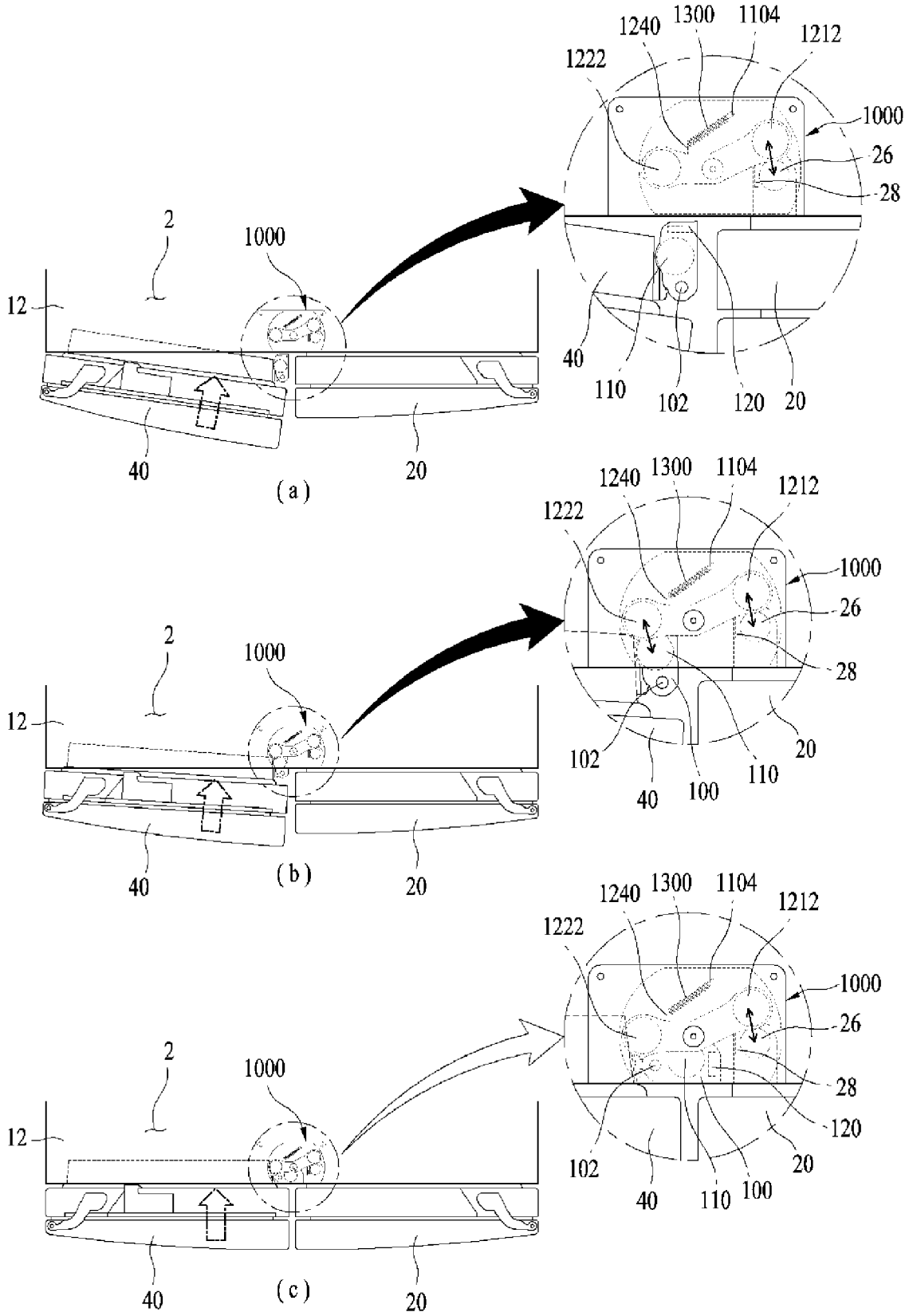

REFRIGERATOR

CROSS-REFERENCE TO RELATED APPLICATIONS

This application is a National Stage application under 35 U.S.C. § 371 of International Application No. PCT/KR2016/001639, filed Feb. 18, 2016, which claims the benefit of Korean Application No. 10-2015-0025404, filed on Feb. 23, 2015. The disclosures of the prior applications are incorporated by reference in their entirety.

TECHNICAL FIELD

The present invention relates to a refrigerator and, more particularly, to a refrigerator having improved convenience of use, the refrigerator being a dual door type refrigerator in which two doors are used to open a single storage compartment.

BACKGROUND ART

Generally, a refrigerator is an apparatus that may keep food fresh for a certain duration by cooling a storage compartment (e.g. a freezing compartment or a refrigerating compartment) while repeating a refrigeration cycle.

The refrigerator includes a compressor, which compresses refrigerant, circulating through a refrigeration cycle, into high-temperature and high-pressure refrigerant. The refrigerant, compressed in the compressor, cools air while passing through a heat exchanger, and the cooled air is supplied into the freezing compartment or the refrigerating compartment.

The refrigerator has a configuration in which the freezing compartment is at the upper side and the freezing compartment is at the lower side. A side by side type refrigerator may be configured such that the freezing compartment and the refrigerating compartment are arranged on the left and right sides, respectively, so as to be adjacent to each other.

In addition, there is another type of refrigerator in which a single storage compartment, provided at the upper side or the lower side, may be opened by two doors, which are arranged side by side.

In the case where two doors are arranged side by side to open or close a single storage compartment, a pillar is installed on one of the two doors. The pillar is provided at any one of the two doors, and functions to increase the sealing efficiency of the storage compartment by coming into contact with the two doors when the two doors seal the storage compartment.

In the related art, in order to rotate the pillar, an inner case of the refrigerator is generally provided with a structure including a protrusion and a guide groove for guiding the rotation of the pillar.

Because the structure for guiding the rotation of the pillar needs to protrude downward from the upper end of the inner case, the related art causes the inconvenience of a user when the user uses a storage compartment.

In addition, in the state in which the door provided with the pillar seals the storage compartment, the pillar may block the path along which a drawer installed in the refrigerator moves because the pillar is moved away and unfolded from the corresponding door. Therefore, in the case where the refrigerator includes two drawers arranged parallel to each other, the drawers must have different widths.

In addition, in consideration of the fact that the pillar is unfolded, in the case where a basket is installed on the door so as to be rotated together with the door, the basket requires a gently curved corner portion so as not to come into contact with the unfolded pillar, which may result in a reduction in the storage capacity of the basket.

DISCLOSURE OF INVENTION

Technical Problem

Therefore, the present invention has been made in view of the above problems, and it is an object of the present invention to provide a refrigerator having improved convenience of use, the refrigerator being a dual door type refrigerator in which two doors are used to open a single storage compartment.

Solution to Problem

In accordance with an aspect of the present invention, the above and other objects can be accomplished by the provision of a refrigerator including a cabinet having a storage compartment, an inner case configured to define an external appearance of the storage compartment, a first door pivotably installed to the cabinet, the first door being configured to open or close one side of the storage compartment, a second door pivotably installed to the cabinet, the second door being configured to open or close a remaining side of the storage compartment, the second door having a pillar configured to be rotated so as to come into contact with the first door, and a transfer member provided inside the inner case so as to guide rotation of the pillar by detecting rotation of the second door, wherein the pillar is spaced apart from both a top wall of the inner case and a bottom wall of the inner case so as not to come into contact with the inner case in a state in which the second door seals the storage compartment.

Advantageous Effects of Invention

According to the present invention, because a structure, which is configured to rotate a pillar, does not protrude into a storage compartment, the capacity of the storage compartment may be increased, and inconvenience of a user due to any protruding structure may be eliminated.

In addition, because the pillar remains folded in the state in which only a door provided with the pillar seals the storage compartment and an opposite door opens the storage compartment, there is no risk that a drawer installed on the side of the opposite door is caught by the pillar when it is pulled out. Accordingly, a pair of drawers arranged next to each other may have the same width.

In addition, because the pillar remains folded in the state in which only the door provided with the pillar seals the storage compartment and the opposite door opens the storage compartment, no basket is caught by the pillar when the opposite door is rotated. Accordingly, a basket may have an angled corner, and consequently may have an increased storage capacity.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a front view illustrating a refrigerator in accordance with an embodiment of the present invention;

FIG. 2 is a view illustrating major components in accordance with the embodiment;

FIG. 3 is a view illustrating a pillar coupler in accordance with the embodiment;

FIG. 4 is a view illustrating the state in which a first door is being closed while a second door is closed;

FIG. 5 is a view illustrating the state in which the first door is being opened while the second door is closed;

FIG. 6 is a view illustrating the state in which the second door is being opened while the first door is closed; and FIG. 7 is a view illustrating the state in which the second door is being closed while the first door is closed.

BEST MODE FOR CARRYING OUT THE INVENTION

Hereinafter, exemplary embodiments of the present invention will be described in detail with reference to the accompanying drawings in order to concretely realize the objects as set forth above.

In the drawings, the sizes or shapes of components may be exaggerated to emphasize more clearly the explanation in the drawings and for convenience. In addition, the terms, which are specially defined in consideration of the configuration and operations of the present invention, may be replaced by other terms based on intensions of users and operators or customs. The meanings of these terms should be construed based on the whole content of this specification.

FIG. 1 is a front view illustrating a refrigerator in accordance with an embodiment of the present invention.

Referring to FIG. 1, the refrigerator in accordance with the embodiment includes a cabinet 1, which defines the external appearance of the refrigerator.

The cabinet 1 has a storage compartment 2 in which food may be stored.

The external appearance of the storage compartment 2 may be defined by an inner case 10 provided inside the cabinet 1. The inner case 10 may include a top wall 12 and a bottom wall 14, which form the inner surface of the storage compartment 2, and the front side of the storage compartment 2 may be open in order to allow a user to access the storage compartment 2 through the front side of the storage compartment 2.

The cabinet 1 is provided at the front side thereof with a first door 20, which is pivotably installed to the cabinet 1 so as to open or close one side of the storage compartment 2, and a second door 40, which is pivotably installed to the cabinet 1 so as to open or close the other side of the storage compartment 2. At this time, when the first door 20 and the second door 40 close the front side of the storage compartment 2, the entire storage compartment 2 may be sealed.

A pillar 100 may be rotatably installed to the second door 40 so as to come into contact with the first door 40. The pillar 100 may generally have a rectangular shape and may be coupled to the second door 40 so as to be rotated relative to the second door 40. At this time, the pillar 100 may be positioned such that the rotated angle thereof relative to the second door 40 varies based on, for example, the angle by which the second door 40 is rotated relative to the storage compartment 2, or whether the first door 20 opens or closes the storage compartment 2.

The pillar 100 has a shorter length than the distance between the top wall 12 and the bottom wall 14 of the inner case 10 so as not to come into contact with the top wall 12 and the bottom wall 14. That is, even if the second door 40 is rotated and seals the storage compartment 2, the pillar 100 does not contact with both the top wall 12 and the bottom wall 14. Each of the top wall 12 and the bottom wall 14 may wholly define a single plane owing to the structural shape of the inner case 10, i.e. because no constituent element, which may prevent the rotation of the pillar 100, is disposed on the top wall 12 and the bottom wall 14.

The first door 20 may include a door dike 22, which defines the rear appearance of the first door 20. In addition, the second door 40 may include a door dike 42, which defines the rear appearance of the second door 40.

Baskets 24 and 44 may be installed to the respective door dikes 22 and 42, and may be used to store various shapes of food therein. At this time, the basket 24, which is installed to the first door 20, which is not provided with the pillar 100, does not interfere with the pillar 100 when the first door 20 is rotated. Therefore, the basket 24 may have an angled corner. Accordingly, the basket 24 may store an increased amount of food compared to a basket having a rounded corner.

The storage compartment 2 may include a first drawer 34, which is located on the side of the first door 20, and a second drawer 32, which is located on the side of the second door 40. At this time, the first drawer 34 and the second drawer 32 may be disposed in the same horizontal plane. That is, the first drawer 34 and the second drawer 32 may be arranged on the left and right sides respectively at the same height within the storage compartment 2. The first drawer 34 and the second drawer 32 may be pulled outward independently of each other.

The first drawer 34 and the second drawer 32 may have the same width. That is, the first drawer 34 and the second drawer 32 may have the same storage capacity, and may be replaced with each other. Assuming that the first drawer 34 and the second drawer 32 have different widths, and thus different shapes, the first drawer 34 and the second drawer 32 need to be differently manufactured, which may inevitably increase manufacturing costs. On the other hand, assuming that the two drawers 32 and 34 have the same shape, manufacturing costs thereof may be advantageously reduced.

In the embodiment of the present invention, the function described above may be implemented because, when the first door 20 is opened and the first drawer 34 is pulled outward in the state in which the second door 40 seals the storage compartment 2, the pillar 100 is not located in the path along which the first drawer 34 is pulled outward. The reason why the pillar 100 is not located in the path will be described later with reference to other drawings.

Meanwhile, in the embodiment of the present invention, the first door 20 and the second door 40 may have the same width. Thus, the first door 20 and the second door 40 may share some of the production processes thereof, which may reduce the production costs of the doors 20 and 40. The reason for this will be described later with reference to other drawings.

A transfer member 1000 may be provided inside the top wall 12 of the inner case 10, and may serve to rotate the pillar 100 under particular conditions.

In the embodiment of the present invention, because the pillar 100 is adapted to be rotated by magnetic force, rather than being rotated by mechanical elements, such as a guide protrusion, the transfer member 1000 may be embedded in the top wall 12 so as not to be exposed to the user.

Accordingly, a portion of the top wall 12, in which the transfer member 1000 is installed, and an adjacent portion, in which the transfer member 1000 is not installed, may be the same height. That is, because the portion in which the transfer member 1000 is installed defines the same plane as the remaining adjacent portion, the user cannot visually check whether the transfer member 1000 is installed in the inner case 10. In this way, problems that occur when the portion in which the transfer member 1000 is installed protrudes, such as inconvenience to the user or a reduction in storage capacity, may be eliminated.

FIG. 2 is a view illustrating major components in accordance with the embodiment.

Referring to FIG. 2, in the embodiment of the present invention, the transfer member 1000 may detect the position of a magnetic piece installed in the first door 20 and may have influence a magnetic piece installed in the pillar 100 so as to allow the pillar 100 to be rotated.

The transfer member 1000, which is installed in the top wall 12 of the inner case 10, may guide the rotation of the pillar 100 by detecting the rotation of the second door 40.

The transfer member 1000 includes an empty space 1100, a rotation arm 1200 rotatably placed in the space 1100, and an elastic member 1300, which provides return force to move the rotation arm 1200 to a specific position when the external force applied to the rotation arm 1200 is removed.

The space 1100 may provide a path along which the rotation arm 1200 may be rotated when external force is applied to the rotation arm 1200, specifically, when the rotation arm 1200 is affected by magnetic force.

At this time, the space 1100 may mean a space provided inside a separate housing, but may also mean a given space defined within the top wall 12 of the inner case 10.

The rotation arm 1200 may have a rotation center 1230, about which the rotation arm 1200 is rotated in one side of the space 1100. The rotation center 1230 may be coupled to the wall surface that defines the outer circumferential surface of the space 1100, thereby allowing the rotation arm 1200 to be rotated about the rotation center 1230.

The rotation arm 1200 may consist of a first arm 1210 and a second arm 1220, which are arranged at opposite sides of the rotation center 1230.

A first magnetic piece 1212, which exerts magnetic force, may be installed on one end of the first arm 1210, and a second magnetic piece 1222, which exerts magnetic force, may be installed on one end of the second arm 1220. The first magnetic piece 1212 and the second magnetic piece 1222 are arranged at opposite sides of the rotation center 1230 of the rotation arm 1200 so as to achieve sufficient rotational force when the rotation arm 1200 is rotated.

At this time, the length of the second arm 1220 may be smaller than the length of the first arm 1210. As such, when the rotation arm 1200 is rotated, the first magnetic piece 1212 may influence the rotation of the rotation arm 1200 even if the magnetic force exerted by the first magnetic piece 1212 is smaller than the magnetic force exerted by the second magnetic piece 1222. This is because the first arm 1210 generates a great torque even if a relatively small force is applied to the first magnetic piece 1212 because the first arm 1210 is long.

The space 1100 may be provided with a fixing portion 1104, and the second arm 1220 may be provided with a fixing boss 1240. The fixing boss 1240 may be formed on the surface of the second arm 1220 that faces the fixing portion 1104. The fixing portion 1104 and the fixing boss 1240 may serve to fix the elastic member 1300. At this time, the elastic member 1300 may be tensioned when external force is applied thereto, and then may return to the original length thereof when the external force is removed.

That is, in the state in which the rotation arm 1200 has been rotated in the counterclockwise direction upon receiving external force, the elastic member 1300 may provide return force to rotate the rotation arm 1200 in the clockwise direction when the external force is removed.

The first door 20 may include a first door magnetic piece 26, which magnetically interferes with the first magnetic piece 1212. The first door magnetic piece 26 and the first magnetic piece 1212 may be arranged so that surfaces thereof that exert magnetic force face each other in order to allow the first door magnetic piece 26 and the first magnetic piece 1212 to be easily magnetically attracted to each other.

In addition, the pillar 100 may include a first pillar magnetic piece 110, which magnetically interferes with the second magnetic piece 1222. The first pillar magnetic piece 110 and the second magnetic piece 1222 may be arranged so that surfaces thereof that exert magnetic force face each other in order to allow the first pillar magnetic piece 110 and the second magnetic piece 1222 to be easily magnetically attracted to each other.

The first door 20 may further include a second door magnetic piece 28 installed in the side surface thereof, and the pillar 100 may further include a second pillar magnetic piece 120 installed in the folded side surface thereof. The second door magnetic piece 28 may magnetically interfere with the second pillar magnetic piece 120. The second pillar magnetic piece 120 and the second door magnetic piece 28 may be arranged so that surfaces thereof that exert magnetic force face each other in order to allow the second pillar magnetic piece 120 and the second door magnetic piece 28 to be easily magnetically attracted to each other.

The repulsive force between magnets may be used between the first magnetic piece 1212 and the first door magnetic piece 26, between the second magnetic piece 1222 and the first pillar magnetic piece 110, or between the second door magnetic piece 28 and the second pillar magnetic piece 120. That is, the first magnetic piece 1212 and the first door magnetic piece 26 may be arranged so as to generate repulsive force therebetween, the second magnetic piece 1222 and the first pillar magnetic piece 110 may be arranged so as to generate repulsive force therebetween, or the second door magnetic piece 28 and the second pillar magnetic piece 120 may be arranged so as to generate repulsive force therebetween.

The use of repulsive force between magnets may overcome the disadvantage whereby greater force is required to detach magnets that are attached to each other when using the attractive force between magnets and the disadvantage whereby two magnets, which are adapted to be attached to each other using the attractive force therebetween, tend to coincide the centers thereof with each other, and therefore are sensitive to a coupling tolerance.

FIG. 3 is a view illustrating a pillar coupler in accordance with the embodiment.

Referring to FIG. 3, the pillar 100 is rotatably provided at the second door 40.

The pillar 100 may be rotatably installed to a pillar coupler 50 provided on the second door 40.

The pillar coupler 50 may apply force to cause the pillar 100 to be folded. That is, the pillar coupler 50 may apply force in the direction in which the pillar 100 is folded, rather than applying force in opposite directions about the pillar 100 (i.e. applying force both in the folding direction and in the unfolding direction). The pillar coupler 50 may adopt any of various elements such as, for example, a spring or a rotation cam assembly therein.

Because the pillar coupler 50 applies force in the direction in which the pillar 100 is folded, it is possible to prevent the pillar 100 from flapping when the second door 40 is opened. That is, because the pillar coupler 50 continuously applies force so as to keep the pillar 100 folded when the pillar 100 is no longer affected by external force applied by, for example, the magnetic pieces, the occurrence of vibrations or noises due to the arbitrary movement of the pillar 100 may be prevented.

In addition, because the pillar coupler 50 applies force in the direction in which the pillar 100 is folded, the pillar coupler 50 may provide auxiliary force when the first door 20 is opened and when the pillar 100 is folded. Although this will be described later, when the first door 20 is opened in the state in which the second door 40 closes the storage compartment 2, the pillar 100 needs to be change to the unfolded state.

FIG. 4 is a view illustrating the state in which the first door is being closed while the second door is closed.

Referring to FIG. 4, in the state in which the second door 40 is closed and the first door 20 is open, the user may rotate the first door 20 in order to close the first door 20.

In order to allow the first door 20 to be rotated so as to seal the storage compartment 2 in the state in which the second door 40 has sealed the storage compartment 2, the pillar 100 needs to be rotated from the folded state to the unfolded state.

As illustrated in FIG. 4(*a*), when the first door 20 is rotated so as to approach the transfer member 1000, magnetic interference occurs between the first magnetic piece 1212 and the first door magnetic piece 26. At this time, because repulsive force is generated between the first magnetic piece 1212 and the first door magnetic piece 26, the rotation arm 1200 is rotated in the counterclockwise direction about the rotation center 1230.

As illustrated in FIG. 4(*b*), as the first door 20 is gradually closed, the rotation arm 1200 is continuously rotated by the first magnetic piece 1212 and the first door magnetic piece 26, creating magnetic interference between the second magnetic piece 1222 and the first pillar magnetic piece 110. At this time, repulsive force is also generated between the second magnetic piece 1222 and the first pillar magnetic piece 110.

Meanwhile, when the rotation arm 1200 is further rotated in the counterclockwise direction in the state of FIG. 4(*b*), the second magnetic piece 1222 is moved so as to be located on the left side of the first pillar magnetic piece 110, causing the pillar 100 to be unfolded by the repulsive force between the second magnetic piece 1222 and the first pillar magnetic piece 110. In particular, the second magnetic piece 1222 may be located on the left side of a rotation center 102 of the pillar 100. The left side of the rotation center 102 of the pillar 100 is the position at which repulsive force for rotating the pillar 100 in the clockwise direction about the rotation center 102 may be provided.

This is because, when the second magnetic piece 1222 is located on the left side of the first pillar magnetic piece 110, the second magnetic piece 1222 applies repulsive force to the first pillar magnetic piece 110, whereby the pillar 100 is rotated so as to be moved away from the second magnetic piece 1222, i.e. so as to be unfolded.

As illustrated in FIG. 4(*c*), when the first door 20 seals the storage compartment 2, the first magnetic piece 1212 is continuously affected by the first door magnetic piece 26. Thereby, the rotation arm 1200 is rotated in the counterclockwise direction and the elastic member 1300 is tensioned.

The pillar 100 is brought into contact with the first door 20 and the second door 40 by the repulsive force between the first pillar magnetic piece 110 and the second magnetic piece 1222, thereby sealing the storage compartment 2. At this time, the repulsive force generated between the first pillar magnetic piece 110 and the second magnetic piece 1222 is greater than the force applied by the pillar coupler 50, thus overcoming the force that is applied by the pillar coupler 50 in order to cause the pillar 100 to be folded.

FIG. 5 is a view illustrating the state in which the first door is being opened while the second door is closed.

Referring to FIG. 5, in the state in which the first door 20 and the second door 40 seal the storage compartment 2, the user may open the first door 20 while the second door 40 remains closed.

As illustrated in FIG. 5(*a*), when the first door 20 and the second door 40 are closed, the pillar 100 is unfolded and comes into contact with the first door 20 and the second door 40 so as to seal the storage compartment 2.

As illustrated in FIG. 5(*b*), because the distance between the first magnetic piece 1212 and the first door magnetic piece 26 increases when the first door 20 is rotated, the rotation arm 1200 may be rotated in the clockwise direction. That is, as the repulsive force between the first magnetic piece 1212 and the first door magnetic piece 26 is reduced, the first door magnetic piece 26 may not sufficiently push the first magnetic piece 1212, and the rotation arm 1200 may be rotated in the clockwise direction by the elastic force of the elastic member 1300. Meanwhile, the rotation arm 1200 may stop the clockwise rotation thereof at the point in time at which the elastic force of the elastic member 1300 is balanced with the repulsive force between the first magnetic piece 1212 and the first door magnetic piece 26.

At this time, as the second door magnetic piece 28 and the second pillar magnetic piece 120 come closer to each other, magnetic interference may occur due to the repulsive force between the second door magnetic piece 28 and the second pillar magnetic piece 120. Accordingly, the pillar 100 may begin to be rotated in the counterclockwise direction by the interference between the second door magnetic piece 28 and the second pillar magnetic piece 120.

As illustrated in FIG. 5(*c*), when the first door 20 is rotated to a specific position, there is substantially no effect of repulsive force between the first door magnetic piece 26 and the first magnetic piece 1212, and therefore the elastic member 1300 may return to the original shape thereof.

Thereby, because there is no interference attributable to the repulsive force between the second magnetic piece 1222 and the first pillar magnetic piece 110, the pillar 100 may be sufficiently folded. In addition, the pillar 100 may be folded by being easily rotated in the counterclockwise direction because the pillar 100 is subjected to force that causes the pillar 100 to be folded by the pillar coupler 50.

In the state in which only the first door 20 is opened, the pillar 100 is in the folded state, thus causing no interference with the drawer 34 on the side of the first door 20 when the user pulls the drawer 34 outward. As such, even when the drawer 34 on the side of the first door 20 and the drawer 32 on the side of the second door 40 have the same width, the pillar 100 does not prevent the user from pulling the drawer 34 outward. That is, when the drawer 34 is pulled out in the state in which only the door 20, which is not provided with the pillar 100, is open, the path along which the drawer 34 is pulled out is not blocked by the pillar 100.

In addition, when only the first door 20 is rotated in the state in which the second door 40 is closed, the pillar 100 is changed to the folded state, which may increase the path along which the basket 24 installed on the back of the first door 20 is moved. This is because the pillar 100 may be folded so as not to prevent the movement of a structure installed on the first door 20, i.e. so as to increase the movement path of the structure.

FIG. 6 is a view illustrating the state in which the second door is being opened while the first door is closed.

Referring to FIG. 6, the second door 40 may be rotated in the state in which the first door 20 is closed.

At this time, in order to allow the second door 40 to be rotated and opened, it is necessary to prevent the pillar 100 from being caught by the first door 20 and thus preventing the rotation of the second door 40.

In the present embodiment, the pillar 100 may be caught and rotated by the first door 20. Therefore, when the second door 40 is rotated in the state in which the first door 20 is stationary, the pillar 100 may collide with and be folded by the first door 20.

Accordingly, the user may open the second door 40 without interference of the first door 20.

FIG. 7 is a view illustrating the state in which the second door is being closed while the first door is closed.

Referring to FIG. 7, the second door 40 may be rotated in the state in which the first door 20 closes the storage compartment 2. At this time, the pillar 100 remains folded. When the second door 40 is opened, as illustrated in FIG. 6, the pillar 100 is changed to the folded state. Because the pillar 100 is subjected to force that causes the pillar 100 to be folded by the pillar coupler 50, the pillar 100 remains folded once the second door 40 has been rotated.

Accordingly, while the second door 40 is rotated so as to seal the storage compartment 2 in the state in which the first door 20 seals the storage compartment 2, the rotation of the second door 40 may be implemented without interference between the pillar 100 and the first door 20.

That is, as exemplarily illustrated in FIG. 7(*b*), because the pillar 100 is folded while the second door 40 is rotated, the pillar 100 is not caught by the first door 20.

As the second door 40 is rotated so as to seal the storage compartment 2, interference occurs between the second magnetic piece 1222 and the first pillar magnetic piece 110. At this time, the pillar 100 may begin to be rotated by the second magnetic piece 1222 from any point in time while interference occurs by the repulsive force between the second magnetic piece 1222 and the first pillar magnetic piece 110.

Because the rotation arm 1200 is substantially fixed so as not to be rotated by the repulsive force between the first magnetic piece 1212 and the first door magnetic piece 26, there is no variation in the position of the second magnetic piece 1222. The pillar 100 may be rotated in the clockwise direction as the position of the first pillar magnetic piece 110 varies via the rotation of the second door 40.

As illustrated in FIG. 7(*c*), when the second door 40 is rotated so as to seal the storage compartment 2, the pillar 100 may overcome force applied by the pillar coupler 50 owing to the repulsive force between the second magnetic piece 1222 and the first pillar magnetic piece 110, thereby being rotated so as to come into contact with the first door 20 and the second door 40.

The present invention is not limited to the embodiments described above, various other alterations of the embodiments are possible by those skilled in the part as can be appreciated from the accompanying claims, and these alterations fall within the scope of the present invention.

Mode for the Invention

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet having a storage compartment;

an inner case configured to define an external appearance of the storage compartment;

a first door pivotably installed to the cabinet, the first door being configured to open or close one side of the storage compartment;

a second door pivotably installed to the cabinet, the second door being configured to open or close a remaining side of the storage compartment, the second door having a pillar configured to be rotated so as to come into contact with the first door; and a transfer member provided inside the inner case so as to guide rotation of the pillar based on rotation of the second door, wherein the pillar is spaced apart from both a top wall of the inner case and a bottom wall of the inner case so as not to come into contact with the inner case in a state in which the second door seals the storage compartment, and wherein the pillar comes into contact with the first door and the second door when the first door and the second door seal the storage compartment.

2. The refrigerator according to claim 1, wherein the transfer member includes a rotation arm configured to be rotated based on whether the first door is rotated.

3. The refrigerator according to claim 2, wherein the transfer member further includes:

a space configured to provide a path, along which the rotation arm is rotated; and an elastic member configured to provide return force to move the rotation arm to a specific position when external force applied to the rotation arm is removed.

4. The refrigerator according to claim 2, wherein the rotation arm is provided on one end thereof with a first magnetic piece, and wherein the rotation arm is provided on a remaining end thereof with a second magnetic piece.

5. The refrigerator according to claim 4, wherein the rotation arm has a rotation center located between the first magnetic piece and the second magnetic piece.

6. The refrigerator according to claim 5, wherein a distance from the rotation center to the first magnetic piece is greater than a distance from the rotation center to the second magnetic piece.

7. The refrigerator according to claim 5, wherein the second magnetic piece is moved to a left side or a right side on the basis of the rotation center about which the pillar is rotated.

8. The refrigerator according to claim 4, wherein the first door includes a first door magnetic piece configured to magnetically interfere with the first magnetic piece.

9. The refrigerator according to claim 4, wherein the pillar includes a first pillar magnetic piece configured to magnetically interfere with the second magnetic piece.

10. The refrigerator according to claim 1, wherein the first door includes a second door magnetic piece provided in a side surface of the first door, wherein the pillar includes a second pillar magnetic piece provided in a folded side surface of the pillar, and wherein the second door magnetic piece and the second pillar magnetic piece magnetically interfere each other.

11. The refrigerator according to claim 10, wherein the second door magnetic piece applies magnetic force to the second pillar magnetic piece so as to keep the pillar folded or unfolded.

12. The refrigerator according to claim 1, wherein the pillar is provided with a pillar coupler configured to apply force to cause the pillar to be folded.

13. The refrigerator according to claim 1, wherein the transfer member is driven using repulsive force between magnetic pieces arranged to face each other.

14. The refrigerator according to claim 1, wherein the pillar is located to be rotatable in a state in which the first door opens the storage compartment and the second door seals the storage compartment.

15. The refrigerator according to claim 1, wherein, in a state in which the first door and the second door seal the storage compartment, the pillar is rotated while the first door is rotated to open the storage compartment.

16. The refrigerator according to claim 1, further comprising:

a first drawer located on a side of the first door; and a second drawer located on a side of the second door, wherein the first drawer and the second drawer have the same width.

17. The refrigerator according to claim 16, wherein the first drawer and the second drawer are arranged in the same horizontal plane, and wherein the first drawer and the second drawer are configured to be pulled outward independently of each other.

18. The refrigerator according to claim 1, wherein the first door and the second door have the same width.

* * * * *